US008403541B1

(12) United States Patent
Rashidi

(10) Patent No.: US 8,403,541 B1
(45) Date of Patent: Mar. 26, 2013

(54) LED LIGHTING LUMINAIRE HAVING REPLACEABLE OPERATING COMPONENTS AND IMPROVED HEAT DISSIPATION FEATURES

(76) Inventor: Hamid Rashidi, Beverly Hills, CA (US)

( * ) Notice: Subject to any disclaimer, the term of this patent is extended or adjusted under 35 U.S.C. 154(b) by 737 days.

(21) Appl. No.: 12/590,530

(22) Filed: Nov. 9, 2009

(51) Int. Cl.
*F21V 29/00* (2006.01)

(52) U.S. Cl. ..... 362/373; 362/249.02; 362/294; 362/296.05; 362/311.02; 362/364; 257/98; 257/99; 257/712

(58) Field of Classification Search ..... 257/98, 257/99, 712; 362/147, 249.02, 294, 296.05, 362/311.02, 364, 373, 800
See application file for complete search history.

(56) References Cited

U.S. PATENT DOCUMENTS

| | | | | |
|---|---|---|---|---|
| 7,722,213 | B2 * | 5/2010 | Inoue et al. | 362/249.02 |
| 7,722,227 | B2 * | 5/2010 | Zhang et al. | 362/364 |
| 7,736,031 | B1 * | 6/2010 | Rashidi | 362/364 |
| 7,959,332 | B2 * | 6/2011 | Tickner et al. | 362/373 |
| 7,993,034 | B2 * | 8/2011 | Wegner | 362/296.05 |
| 8,070,328 | B1 * | 12/2011 | Knoble et al. | 362/311.02 |

* cited by examiner

*Primary Examiner* — Stephen F Husar
(74) *Attorney, Agent, or Firm* — Thomas I. Rozsa

(57) ABSTRACT

A light emitting diode (LED) lighting luminaire designed to have detachable components for convenience and low cost in the luminaire maintenance including a heat dissipation means that includes detachable upper and lower sections, where the upper section has a top central recess of space positioned by horizontal heat dissipation fins and a driver that is surround by longitudinal fins for efficient dissipation of heat generated by an LED lighting source to thereby effectively cool the LED lighting source and driver.

16 Claims, 9 Drawing Sheets

| |
|---|
| FIG. 4A |
| FIG. 4B |
| FIG. 4C |

LED LIGHTING LUMINAIRE HAVING REPLACEABLE OPERATING COMPONENTS AND IMPROVED HEAT DISSIPATION FEATURES

BACKGROUND OF THE INVENTION

1. Field of the Invention

The present invention relates to the field of recessed lighting luminaires and in particular to recessed lighting luminaires which have light emitting diodes (LEDs) as the source of illumination.

2. Description of the Prior Art

With the development of semiconductor lighting devices, LED lighting sources including LED chips are in great demand in lighting luminaires used in both consumer and industrial markets. One problem with the existing LED lighting luminaires in the market and in particular with recessed lighting luminaires is that the LED lighting sources generate considerable heat. Excess heat can result in failure of the operating components of the lighting luminaires. Therefore it is necessary to incorporate a heat dissipation apparatus into the LED lighting source of each luminaire in order to achieve a reasonable usable life for the fixture.

Another problem with prior art LED lighting luminaires including the recessed lighting luminaires is that all of the components are integrated into the luminaire so if one component goes bad, the failed component can't be replaced and it is necessary to replace the entire recessed lighting luminaire. Therefore, there is a significant need for an improved recessed lighting luminaire which contains replaceable operating components so that if one component fails, only the failed component needs to be replaced and the entire lighting fixture does not need to be discarded.

Particularly, in the current market for recessed lighting luminaires having the LED lighting sources, the existing heat dissipation apparatus is manufactured as a single piece. Therefore the prior art luminaires have less efficient heat dissipation which results in reduced life of the luminaires. In addition, in prior art luminaires LED chips are permanently affixed to the apparatus. The result is that the entire apparatus must be replaced if the LED chips malfunction or otherwise fail in some manner.

Therefore there is a significant need for the recessed lighting luminaires which have an improved structure including an improved heat dissipation apparatus.

SUMMARY OF THE INVENTION

The present invention is an LED lighting luminaire including a recessed lighting luminaire utilizing an LED chip as the source of illumination, which has detachable and replaceable components for convenience and low cost in the luminaire maintenance, and improved heat dissipation means including a central recess positioned by transverse fins or veins for efficient heat dissipation.

The detachable and replaceable components of the lighting luminaire include a bottom hollow cylindrical trim ring cover, a lens, a hollow reflector, a heat dissipation apparatus which is a combination of lower and upper sections or members, an LED chip, a socket supporting member, a driver, an electrical connector having mated first and second members, two longitudinal supports, and a top round plate.

The bottom hollow cylindrical trim ring cover includes interior circumferential baffles for producing an aesthetic lighting effect, an interior circumferential shelf for positioning the lens, and a pair of torsion springs for affixing the lighting luminaire to a ceiling structure.

The upper member of the heat dissipation apparatus includes multiple longer longitudinal fins that are circumferentially spaced, a majority of which come in contact with an outer circumferential plate, and multiple shorter longitudinal fins that are circumferentially spaced and also come in contact with a portion of the outer circumferential plate. In addition, a multiplicity of transverse fins are positioned on a top side of the plate, and are surrounded by either the longer fins or the shorter fins. Therefore, the longer and shorter longitudinal fins which surround the transverse fins create a central recess above the transverse fins which provides an opening to position a driver and also forms pathways through all of the fins by which air can circulate to provide a means for heat dissipation.

The socket supporting member includes the top socket affixing means for affixing a removable female socket that is transversely oriented, wherein the female socket is threaded to connect to a detachable male socket that is also transversely oriented. Therefore, the transverse orientation in connection of the sockets makes the present invention more versatile since it decreases overall height of the lighting luminaire as compared with the sockets of the existing lighting luminaires in the market that are longitudinally oriented in the electrical connection. This enables the present invention lighting luminaire to fit into shorter applications than prior art devices.

The detachable electrical connector includes first and second members that are matched to each other, wherein the first member is connected to inlet wires of the driver and the second member is connected to the male socket that matches the female socket, which is regularly positioned inside of a canister. For connecting the lighting luminaire to the ceiling electrical supply, the male socket is first connected to the female socket, and then the first and second members of the connector are connected together. Therefore, the present invention can avoid seriously twisting the inlet electrical wires to thereby prevent damage to the wires during the luminaire installation.

The present invention includes significant design improvements which are summarized as follows:

One significant improvement in the present invention is a replaceable driver (which functions as a transformer). The driver is located adjacent the top of the luminaire so that a cover can be removed to facilitate quick access to the driver. The driver can be removed and replaced. In this away, if the driver fails or otherwise malfunctions, the driver is replaced and the remainder of the luminaire is salvageable and can continue to be used.

A second significant improvement in the present invention is a replaceable male socket. In prior art recessed lighting luminaires the male socket is already built into the luminaire so if the socket fails or goes bad in a some way, it can't be replaced and the entire luminaire needs to be replaced. In the present invention, the replaceable male socket is connected to a detachable plug-in connector having first and second mating connecting members. The second mating connector is connected to the male socket, which is in turn threaded into the female socket which in turn is electrically connected to the source of power in the structure. The first mating connecting member is connected to the driver, so that power is provided to the luminaire. Therefore, if the male socket and or connector goes bad, the mating connecting members can be separated and the male socket and its mating connector member are replaced with a new male socket and mating connector member.

A third significant improvement in the present invention is a replaceable lens. In prior art recessed lighting luminaires, the lens is not replaceable. Therefore, if the lens is cracked or incurs some other defect, it can be replaced in the present invention and the recessed lighting luminaire does not need to be discarded.

A fourth significant improvement in the present invention is that the LED chip which services as the source of illumination is replaceable. In the prior art luminaires, the LED chips are not replaceable.

A fifth significant improvement in the present invention is the inclusion of an led retrofit kit. This is facilitated by the use of paired torsion springs which hold the recessed lighting luminaire in the cannister. In the prior art, a push in spring clip is used. The present invention torsion spring is better because at all times it gives tension whereas the prior art design can lose tension and cause the lamp assembly to fall out of the cannister.

A sixth significant improvement in the present invention is the use of a surface polished aluminum reflector. The reflector has a special texture that reflects the light better, which produces a flood effect. Since the reflector is also replaceable, if desired a different reflector which produces a spot effect can be used. The surface of the reflector is stepped as opposed to being smooth as in the prior art. The orientation of the steps is horizontal which provides a better lighting effect than the prior art where the steps are vertically oriented or the surface is smooth.

A seventh significant improvement in the present invention is the addition of an air cavity between the driver and LED chip, wherein a plurality of horizontal fins are positioned, so that air inside the luminaire will flow away from the cavity and around multiple vertical fins which surround the horizontal fins, which is a significant improvement over the prior art that has no such air gap cavity and therefore the prior art lighting luminaire heats up considerably. In the present invention, horizontal fins create an air gap between the LED chip and the driver so that they act as an additional heat sink due to their transmitting heat outwardly toward the outward vertical fins to help cool the recessed lighting luminaire. Therefore, the present invention LED lighting luminaire is much cooler and lasts much longer than the prior art luminaires. In the present invention luminaire, the driver also runs much cooler than the prior art drivers. In addition, a horizontal plate on which the driver is set is positioned higher than the horizontal veins to thereby create another air gap which supplements the cooling.

An eighth significant improvement in the present invention is to have the electrical connection of the source of power transmitted through a female socket which in the present invention can be held by a bracket of the luminaire so that the female socket is oriented transversely. In the prior art the female socket is always vertically oriented. This presents an installation problem if the area in the ceiling does not have sufficient height to accommodate the luminaire. By orienting the female socket in a transverse direction, the height requirement is reduced so that the present invention can fit in a shorter area in the ceiling. The prior art does not have this feature which has a fixed vertically oriented female socket. Therefore, the transverse female socket is held in the bracket to give it not only a more secure fitting when the detachable male socket from the fixture is threaded into the female socket which is held by the bracket, but also makes the present invention electrical connecting device more universal.

In addition, the male socket is connected to the second mating connecting member of a detachable connector having the first and second members. Therefore, the present invention can have electrical connection of the first and second members after the male socket is screwed into the female socket so that there is no twisting of the wires. In the prior art the wires are twisted and sometimes broken.

A ninth improvement in the present invention is the use of a single chip that produces white light. In the prior art, a multiplicity of chips are used to create the color effect. Therefore, in the present invention, only one chip needs to be replaced and not a multiplicity of chips.

A tenth improvement in the present invention is to design the heat dissipation apparatus including the detachable upper and lower sections or members. Therefore, it is easy to replace the LED chip if it goes bad or malfunctions, since the LED chip is removably affixed on a bottom side of the upper member. The upper and lower heat dissipation sections can be separated so that the chip attached to a bottom surface of the upper heat dissipation section can be easily accessed and removed and replaced.

It is therefore an object of the present invention to provide an LED lighting luminaire which is designed to have detachable and replaceable components for convenience and low cost in the luminaire maintenance, and a central recess that includes transverse fins to improve heat dissipation.

It is also an object of the present invention to provide the detachable and replaceable components of the lighting luminaire, which include a bottom hollow cylindrical trim ring cover, a lens, a hollow reflector, a heat dissipation structure which includes a lower member and an upper member, an LED chip, a socket supporting member, a driver, an electrical connector having matched first and second members, two longitudinal supports, and a top round plate. Therefore, the present invention provides low maintenance costs since each component is replaceable and the entire luminaire does not have to be discarded if only one or more components need to be replaced.

It is an additional object of the present invention to provide a bottom hollow cylindrical trim ring cover, which includes interior circumferential baffles for producing an aesthetic lighting effect, an interior circumferential shelf for positioning the lens, and a pair of torsion springs for affixing the lighting luminaire to a ceiling structure.

It is a further object of the present invention to provide an upper member of the heat dissipation structure which includes a multiplicity of longer longitudinal fins that are circumferentially spaced and are attached to a circumferential plate, a multiplicity of shorter longitudinal fins that are circumferentially spaced and are also connected to the circumferential plate to encircle an interior area. Transverse fins are position on top of the plate and within the area encircle by the longer and shorter longitudinal fins. Therefore, the longer and shorter longitudinal fins and transverse fins of the present invention create a central cavity or recess, which provides not only an area for positioning the driver but also facilitates pathways of air circulation for improved heat dissipation.

It is another object of the present invention to provide a socket supporting member which includes a top socket affixing means to affix a removable socket that is transversely oriented. Therefore, the transverse orientation in installation of the socket makes the present invention more versatile since it decreases overall height of the lighting luminaire as compared with the socket of the existing lighting luminaire in the market that is longitudinally oriented. This enables the present invention lighting luminaire to fit into shorter spaces than the prior art fixtures.

It is another object of the present invention to provide a detachable electrical connector which includes first and second members that are matched to each other, wherein the first member is connected to inlet wires of the driver and the second member is connected to a male connector that matches a socket positioned inside of a canister. For connecting the lighting luminaire to the ceiling electrical supply, the male connector is first connected to the female socket which is connected to the source of power, and then the first and second members are connected together. Therefore, the present invention will avoid seriously twisting the inlet electrical wires to thereby prevent damage of the wires during installation of the lighting luminaire.

Further novel features and other objects of the present invention will become apparent from the following detailed description, discussion and the appended claims, taken in conjunction with the drawings.

BRIEF DESCRIPTION OF THE DRAWINGS

Referring particularly to the drawings for the purpose of illustration only and not limitation, there is illustrated.

DETAILED DESCRIPTION OF THE PREFERRED EMBODIMENTS

Although specific embodiments of the present invention will now be described with reference to the drawings, it should be understood that such embodiments are by way of example only and merely illustrative of but a small number of the many possible specific embodiments which can represent applications of the principles of the present invention. Various changes and modifications obvious to one skilled in the art to which the present invention pertains are deemed to be within the spirit, scope and contemplation of the present invention as further defined in the appended claims.

Figure 1:
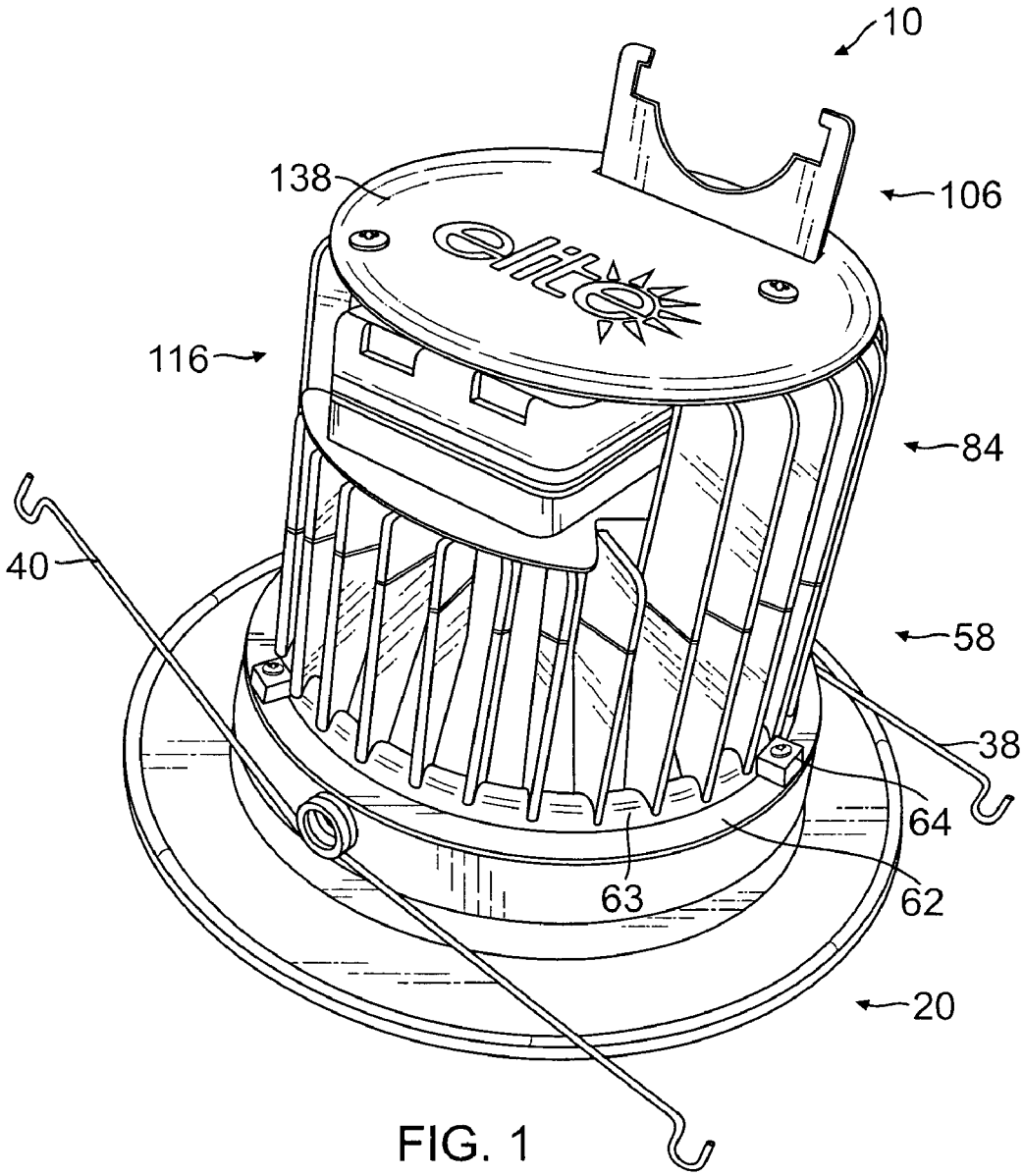
FIG. 1 is a perspective view of an LED lighting luminaire of the present invention.
Figure 2:
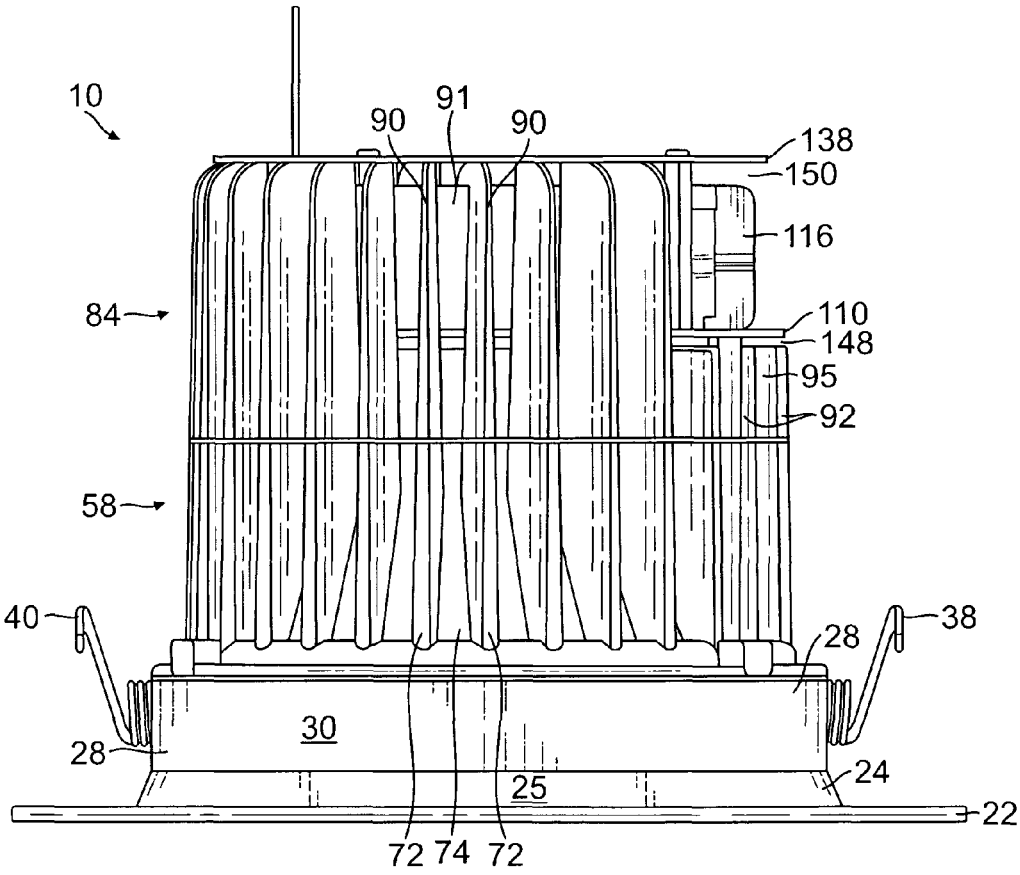
FIG. 2 is a side view of the present invention LED lighting luminaire.
Figure 3:
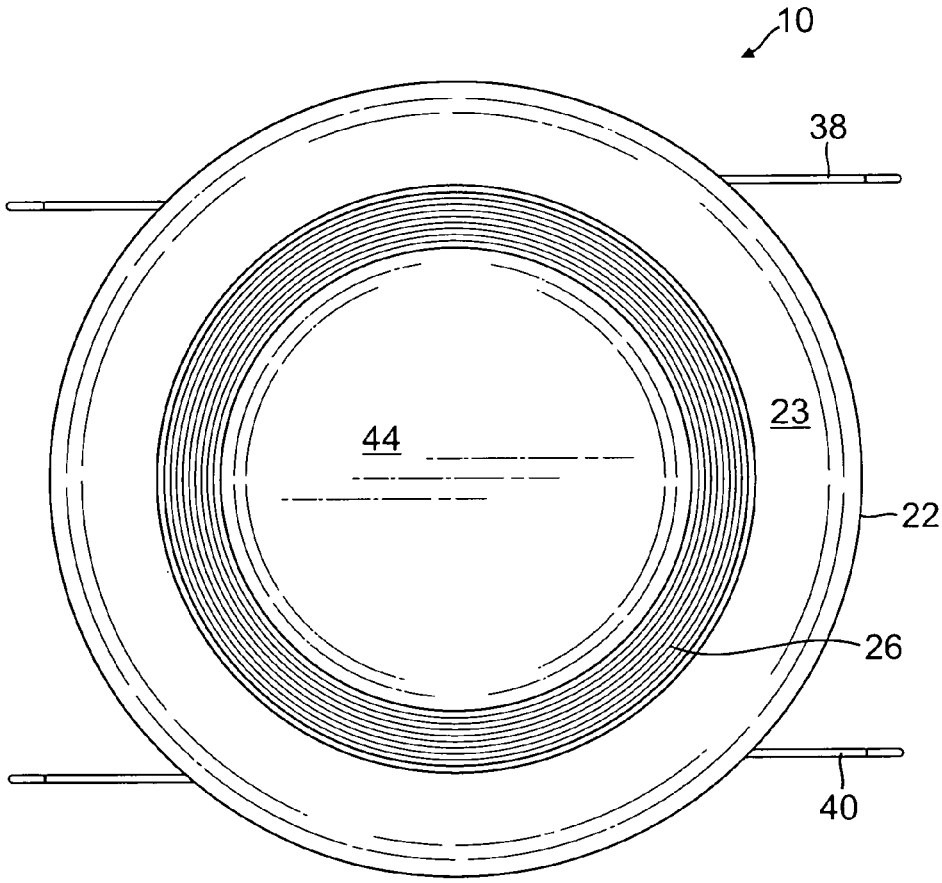
FIG. 3 is bottom plan view of the present invention LED lighting luminaire.

Referring to FIGS. 1 to 3, there is illustrated present invention LED lighting luminaire 10 which is designed to have detachable and replaceable components to enable one failed component to be replaced while the remainder of the fixture is used and not discarded. The LED fixture also includes vertically oriented heat dissipation fins and transversely oriented heat dissipation fins.

A key innovation of the present invention is the very unique heat dissipation apparatus or broadly speaking the heat dissipation means which is a significant improvement over the prior art. Referring to FIGS. 1, 2, 4B and 5, the heat dissipation means is comprised of a first or lower heat dissipation section 58 having a circumferential connecting ring 60 which is incorporated into a frustum shaped body 61 having an interior surface 68, an exterior surface 67 and a circumferential top end 70 surrounding a central opening 71. The frustum shaped body 61 also extends into a lower circumferential surface 63 which lies interiorly of and is attached to the upper surface 62 of the connecting ring 60.

Formed into the exterior surface 67 of the frustum shaped body 61 are a multiplicity of spaced apart longitudinal fins 72 which extend radially away from the exterior surface 67 of the first heat dissipation member body 61, and are also attached to the lower circumferential surface 63. Each longitudinal fin 72 is separated from an adjacent longitudinal fin by an air gap 74. Therefore, the principal heat dissipation means of the first heat dissipation section or member 58 are the multiplicity of radially extending and spaced apart heat dissipation fins 72 and multiplicity of air gaps 74, with each respective longitudinal heat dissipation fin 72 separated from an adjacent longitudinal heat dissipation fin by an air gap 74.

A second or upper heat dissipation section 84 of the heat dissipation means includes a circumferential plate 85, which serves as a body of the upper section, the circumferential plate 85 having a bottom central recessed surface 88 that connects to a circumferential mating ring surface 89. Incorporated into the second heat dissipation section 84 are a multiplicity of spaced apart long longitudinal heat dissipation fins 90 respectively separated by air gaps 91 and a multiplicity of spaced apart short heat dissipation fins 92 having the respective tops 93, which are separated by the respective air gaps 95.

Figure 5:
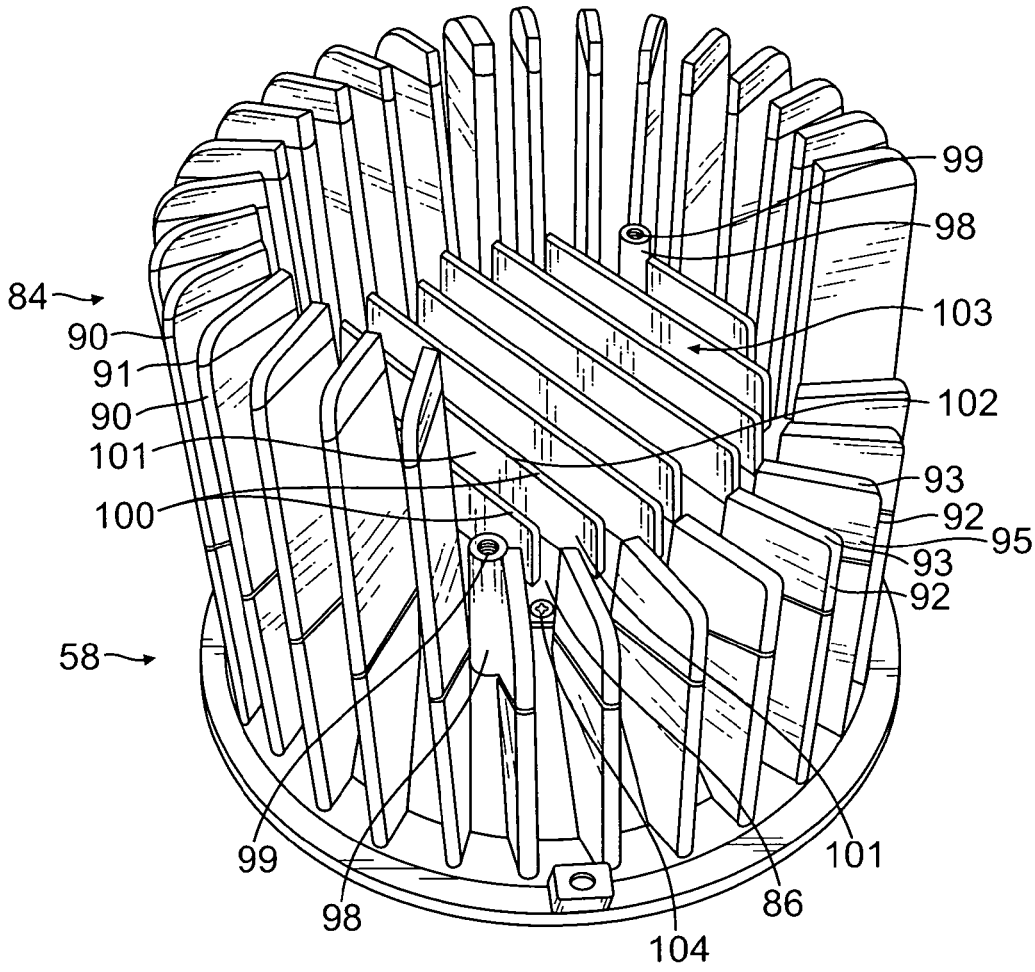
FIG. 5 is a perspective view of the heat dissipation structure wherein the upper and lower members are combined together.

As best illustrated in FIG. 5, the long longitudinal heat dissipation fins 90 are formed around approximately three quarters of the circumference of the plate 85 of the second heat dissipation member 84 and the short heat dissipation fins 92 having the respective tops 93 are formed around approximately twenty-five percent of the circumference. The longitudinal heat dissipation fins 90 and 92 surround the plate including its top surface 86. As illustrated, another key innovation of the improved heat dissipation apparatus in the present invention is a multiplicity of horizontally oriented or transverse heat dissipation fins 100 having the respective tops 102. The transverse heat dissipation fins 100 are positioned on the plate top surface 86. The transverse heat dissipation fins 100 are separated by respective air gaps 101, with each horizontal heat dissipation fin 100 separated from an adjacent horizontal heat dissipation fin 100 by an air gap 101. The height of the horizontal heat dissipation fins 100 are much shorter than the long longitudinal heat dissipation fins 90 to thereby form an open area 103 partially surrounded by the long longitudinal heat dissipation fins 90 and the horizontal heat dissipation fins 100 beneath the open area 103. The short heat dissipation fins 92 are also spaced around a portion of the circumference of the horizontal heat dissipation fins 100.

The second or upper heat dissipation section 84 is removably affixed to the first lower heat dissipation section 58 by connecting means such as threaded bolts or screws. By way of example, at least one and preferably a multiplicity of spaced apart affixing screws 104 extend through openings 87 of the circumferential plate 86 and into receiving mating openings on the circumferential top 70 of the frustum shaped body 61 of lower heat dissipation section 58, to connect the two sections together. Additional attaching means can include at least one and preferably a pair of spaced apart threaded affixation supports 98 or posts with internal threads having the respective tops 99 in the second section 84. The tops 99 of the supports 98 have the internal threads which are used for supporting a socket supporting member 106. As further illustrated, the tops 99 are designed to be positioned higher than the tops 102 and 93 of the respective horizontal and short longitudinal fins 100 and 92.

The two heat dissipation sections 58 and 84 are connected together so that a respective long longitudinal heat dissipation fin 90 or a respective short longitudinal heat dissipation fin 92 of the second or upper section 84 is aligned in with a respective longitudinal heat dissipation fin 72 of the first or lower section 58 so that the respective air gaps 91 and 95 of the upper section 84 are respectively aligned with the respective air gaps 74 of the lower section 58.

Referring again to FIG. 4B, the bottom central recessed surface 88 of the upper heat dissipation section 84 has a multiplicity of the threaded receiving openings 94 extending through it. The LED chip 76 also has corresponding openings 78 so that the LED chip can be removably connected to the bottom central recessed surface 88 of the circumferential plate 85 by affixing mean such as threaded screws or bolts. In addition, the LED chip includes a rectangular shaped LED 77 positioned on a center of a front surface of the chip, and a thermally conductive adhesive or patch 76A positioned on a rear side of the chip for better transferring heat after the chip is attached to the bottom central recessed surface 88. At least one and preferably two oppositely disposed wire connecting openings 96 are formed into the recessed surface 88 adjacent the outer circumferential ring surface 89 so that connecting wires 80 can be extended through the openings 96 to connect the LED Chip 76 to a driver. Therefore, another significant improvement of the present invention is that the LED chip 76 can be replaced if it fails.

It will be appreciated that the present invention has an LED chip which emits white light and therefore only one chip is used with the present invention as opposed to a multiplicity of colored chips which are used in the prior art. Therefore, if there is an LED failure, only one chip needs to be replaced.

Figure 4A:
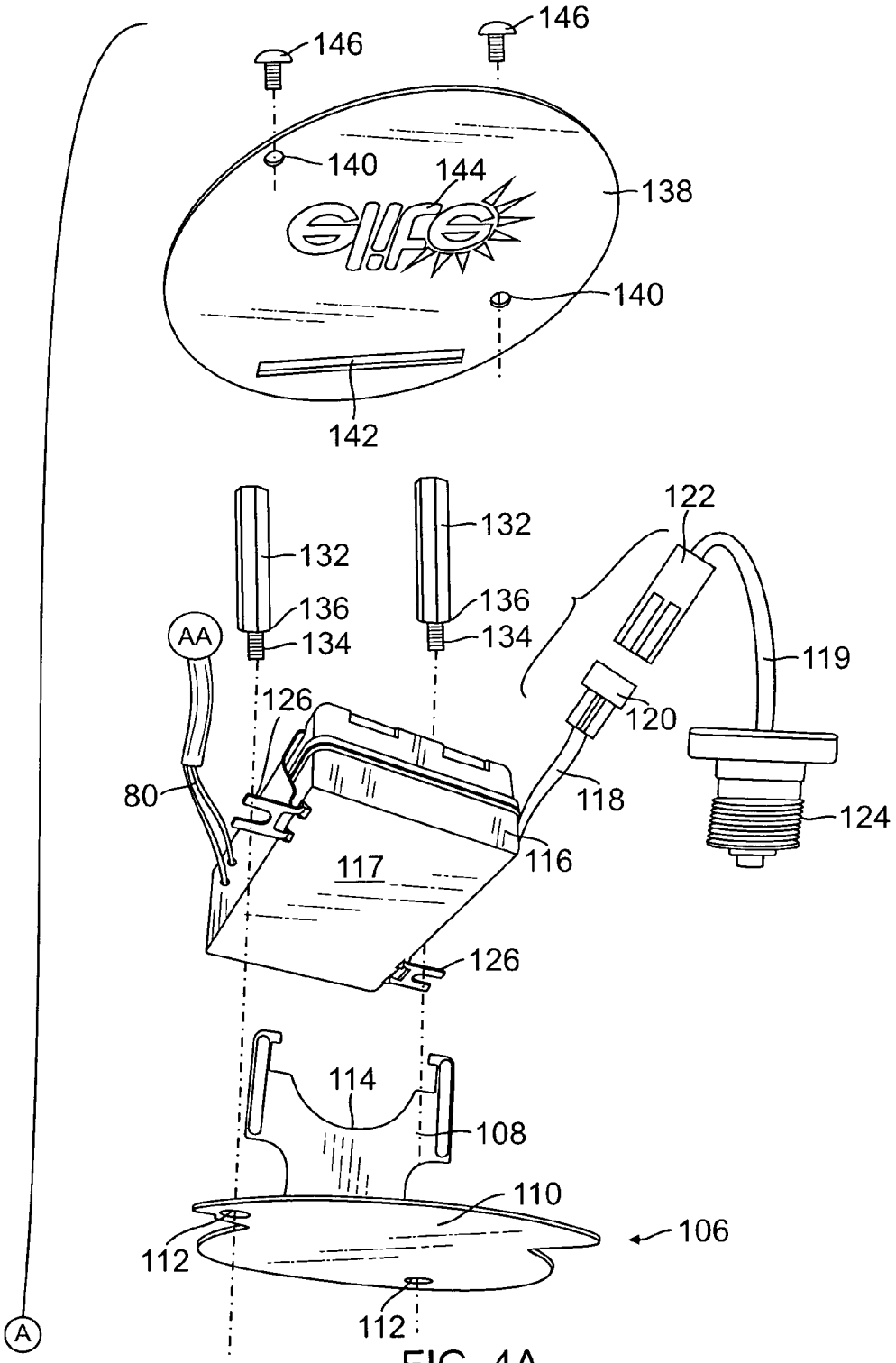
FIG. 4A is an exploded view of a socket supporting member, a driver and a top plate.

The driver and socket support member are illustrated in FIG. 4A. The socket support member 106 is an "L" shaped structure including a transverse plate 110 which is connected to a longitudinal socket receiving plate 108. The transverse plate also includes a pair of spaced apart openings 112 which extend through the transverse plate 100 and are respectively aligned with the threaded support members 98 in upper or second heat dissipation section 84. The longitudinal socket receiving plate 108 further comprises a socket receiving bracket 114 which removably receives the female socket 500 shown in dotted lines female socket 500 is oriented in a horizontal or transverse direction and which is electrically connected to the source of power.

Seated on the transverse plate 110 is the driver or transformer 116 having a bottom surface 117 that comes into contact with the transverse plate 110. The driver 116 receives electricity from the source of electricity connected to the electrical outlet and transmits electricity to the LED chip 76. Another significant innovation of the present invention is that the driver 116 is removable and replaceable. The driver 116 is connected by electrical wires 118 to a second mating connecting member 120 which can be a female member. The connecting male socket 124 is connected by wires 119 to a first mating connecting member 122.

The male socket 124 is then threaded into a removable female power socket 500 held by bracket 114 along a transverse orientation, which is an option of the luminaire installation provided by the present invention. This option not only provides a much more secure hold but also makes the device more universal. This is because the male socket in the prior art is fixed along the vertical orientation, which causes a longer connection to a female socket that is also vertically oriented as compared with a shorter connection of the present invention due to the fact that both sockets are oriented along a horizontal direction.

The male socket in the present invention is removable and has a horizontal orientation. Therefore, the luminaire of the present invention provides a shorter connection than the prior art which has the male and female sockets both along a vertical orientation. The vertical distance of the present invention luminaire is decreased because the male socket is horizontally oriented instead of vertically oriented to connect to the female socket that is also horizontally oriented, wherein the female socket is connected an outlet of electricity, for example a plug of a canister positioned to a ceiling structure.

The horizontal orientation of the male socket in the luminaire installation makes the present invention luminaire more versatile because it decreases the overall height of the luminaire so even in shorter applications it will fit whereas in the prior art the vertical height may be too long. It will be appreciated that, in a situation regarding installation of the luminaire when there is a sufficient height of a ceiling structure positioned with a canister having a female socket, the removable male socket 124 can be directly connected to the female socket which is kept vertically positioned inside of the canister, instead of being removed from the canister and being positioned to the bracket 114 in the situation when the short connection is needed.

In addition, in the prior art the wires are twisted and sometimes broken when the male socket is threaded into the female socket. By having the detachable first and second connecting members 122 and 120, the present invention luminaire prevents damage of the electrical wires when connecting the male socket 124 to the female socket, which can be positioned vertically or horizontally. This is because the first and second mating connecting members will be connected after completion of connecting the male and female sockets together.

Furthermore, this mating connection also enables the driver to be removed and replaced if the driver 116 should malfunction. The driver also comprises a pair of oppositely disposed connecting hooks 126 which are respectively aligned with openings 112 of the transverse plate 110. Fastening means 132 are placed through the connecting hooks 126, openings 112 and threaded into threaded support members 98 to affix the driver 116 to the heat dissipating means including the upper and lower sections 84 and 58. The fastening means also have internal threaded tops.

The cover plate 138 has a slot 142 to enable the socket receiving plate 108 having bracket 114 to extend above the plate so that the female power socket can be clipped to the bracket and male connecting socket 124 threaded into the female power socket as described above. Fastening means 146 extend through respective openings 140 in the cover plate 138 and fasten the plate onto the threaded receiving portion in the fastening means 132. This design is a significant improvement in the present invention. Since the driver 116 is located adjacent the top cover 138, the driver 116 can be quickly replaced by removing the top cover 138 and disconnecting and replacing the driver 116.

An extremely important innovation in the present invention is a significant improvement in air circulation around the driver 116 positioned in the open area 103 and enhanced heat dissipation by addition of the horizontal veins or fins 100 attached to the top surface 86 of the circumferential plate 85. Therefore, the driver and LED chip run much cooler than the respective prior art driver and LED lighting sources and therefore they last much longer.

Figure 4B:
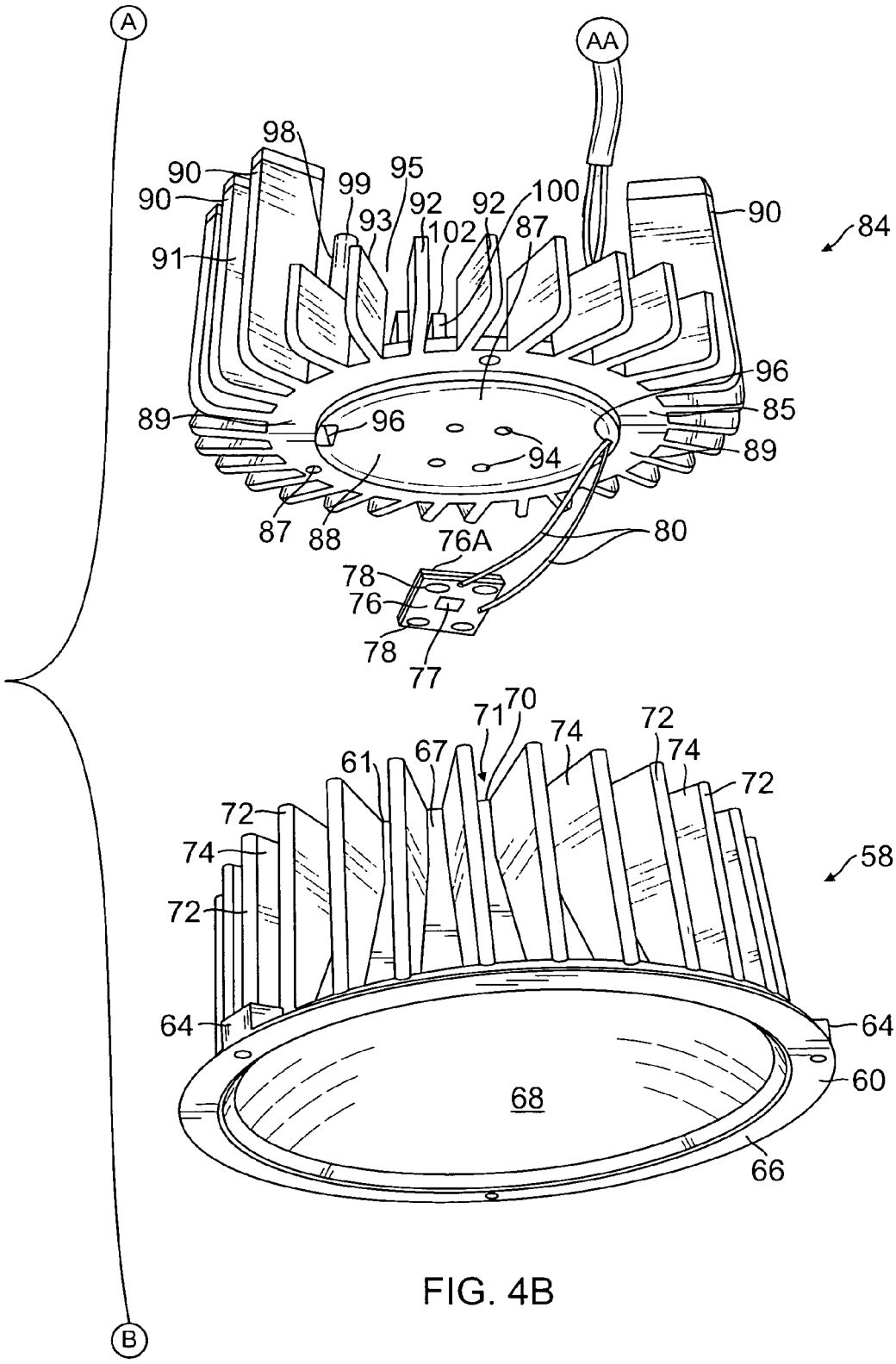
FIG. 4B is an exploded view of a heat dissipation structure and an LED chip, wherein the heat dissipation structure includes lower and upper members.
Figures 4, 4C:
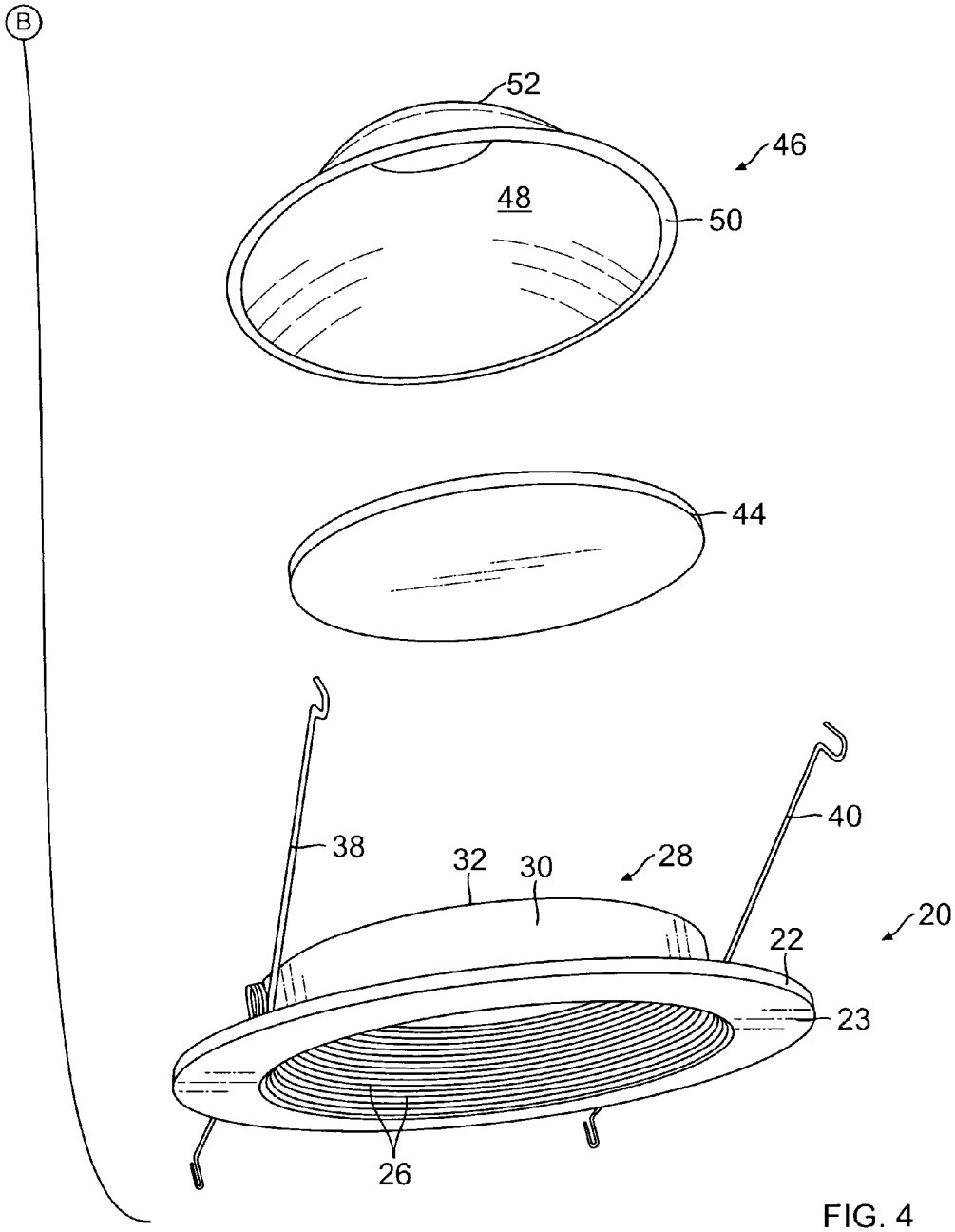
FIG. 4C is an exploded view of a bottom cylindrical trim ring cover, a lens, a reflector and torsion springs.

As particularly illustrated in FIGS. 2, 4B and 5, a first air gap 148 is positioned between the transverse plate 110 and top side 86 of the circumferential plate, wherein a plurality of the horizontal veins or fins 100 having the respective tops 102 are positioned thereon. The transverse plate 110 which is supported by the affixation supports 98 is positioned higher than the tops 102 and 93 of the respective horizontal and short longitudinal fins 100 and 92. As illustrated before, the plate 85 has the bottom central recessed surface 88 where the LED chip 76 is attached. Therefore, the heat generated by the chip 76 heats the heat dissipation means so that the heat dissipates including dissipating from the horizontal veins 100. In addition, a second air gap 150 is positioned between the driver 116 and the cover plate 138. In this setting these two air gaps provide substantial air circulation of air through areas around the driver, and through the gaps 91, 95 and 101 between the respective longitudinal fins and horizontal fins 90, 92 and 100 of the upper section. In addition, the longitudinal fins 72 and gaps 74 of the lower heat dissipation member additionally contribute the heat dissipation.

The significant improvement in the present invention is the addition of the air cavity 103 between the driver and LED chip wherein the horizontal veins or fins 100 are additionally positioned so that air will flow through the cavity and away from a multiplicity of veins or fins (both longitudinal and horizontal). This is a significant improvement over the prior art lighting luminaire which has no such air cavity and horizontal veins and therefore the lighting luminaire heats up to cause a high temperature of components including the LED chips and driver. In the present invention, the horizontal fins or veins 100 create an air gap between the LED attached onto the bottom central recessed surface of the circumferential plate 88 and the driver so that the fins or veins 100 act as additional heat sinks due to their dissipating the heat. The hot air flows outwardly toward the outward vertical veins or fins 90 and 92 to thereby help cool the luminaire so it including the LED chip 76 and driver 116 is much cooler and lasts much longer than the prior art luminaires. The horizontal plate 138 is set higher than the driver 116 to create the air gap 150 which supplements the cooling.

As further illustrated in FIGS. 2, 4A; 4B, and 4C, the lighting luminaire 10 further comprised of a bottom hollow cylindrical trim ring cover 20, a lens 44, and a hollow reflector 46.

The bottom hollow cylindrical trim ring cover 20 is comprised of a bottom transverse ring 22 having a bottom exterior surface 23. The ring 22 at its inner circumference is connected to a hollow circular section 24 having a frustum shaped exterior surface 25 and interior surface. On the interior surface, there are a plurality of transverse circumferential baffles or grooves 26 for producing an aesthetic light effect when the lighting luminaire is in use. The hollow frustum shaped circular section 24 in turn is connected to a cylindrical wall 28 having an exterior surface 30, an interior surface and a circular top 32. It will be appreciated that a plurality of threaded holes are positioned on the top 32 of the wall for assembling the lighting luminaire, and an inner circumference shelf is positioned on the interior surface of the wall for positioning the lens 44.

In addition, a pair of torsion springs 38 and 40 are respectively affixed at oppositely disposed locations on the exterior surface 30 of the cylindrical wall 28. With the aid of the torsion springs, the lighting luminaire 10 can be positioned onto an upper position of a lighting cannister when the torsion springs 38 and 40 are affixed to the respective attachment means such as hooks within a canister that is affixed to the building structure. Therefore, the springs hold the lighting luminaire 10 in the cannister. The present invention torsion spring is better because at all times it gives tension whereas the prior art design can lose tension because it is a push-in spring clip.

Figure 6A:
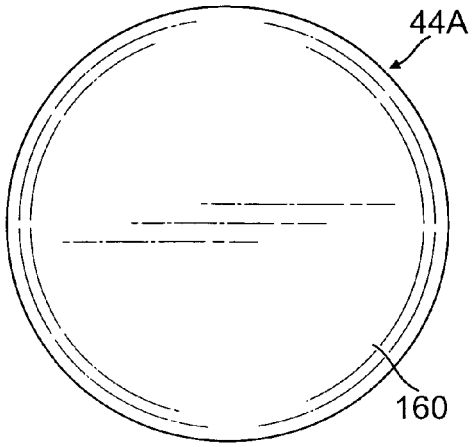
FIG. 6A is a front plan view of the lens according to a first embodiment of the lens, wherein the front surface of the lens is frosted.
Figure 6B:
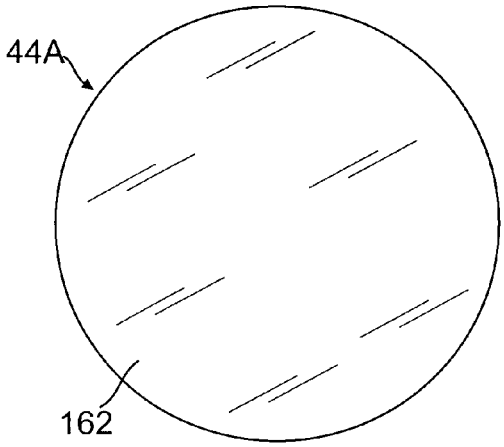
FIG. 6B is a rear plan view of the lens according to the first embodiment of the lens, wherein the rear surface of the lens is smooth.
Figure 6C:
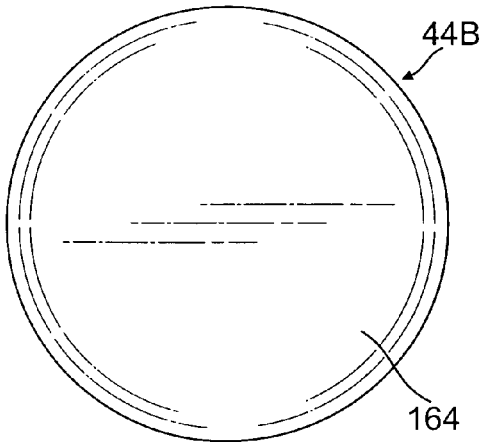
FIG. 6C is a front plan view of the lens according to a second embodiment of the lens, wherein the front surface of the lens is frosted.
Figure 6D:
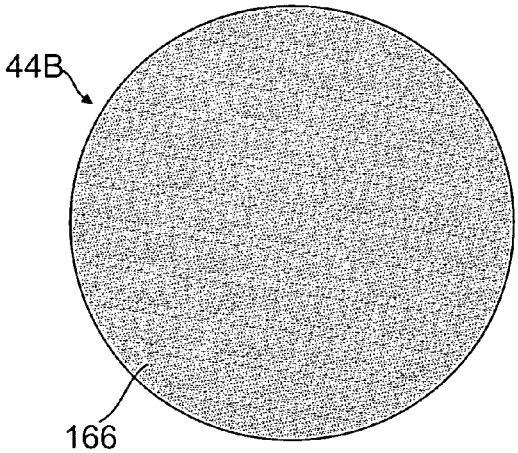
FIG. 6D is a rear plan view of the lens according to the second embodiment of the lens, wherein the rear surface of the lens is sanded.
Figure 6E:
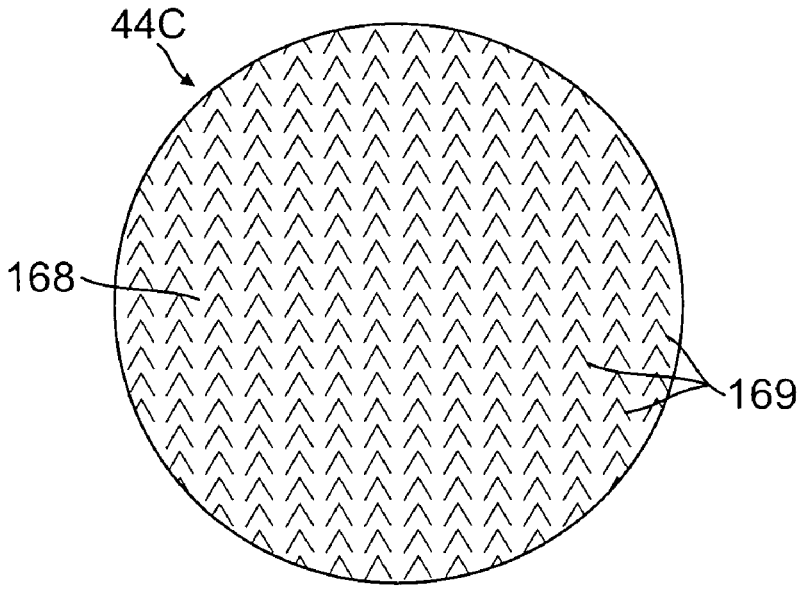
FIG. 6E is a front plan view of the lens according to a third embodiment of the lens, wherein there is a plurality of evenly distributed raised prisms or dots throughout the surface extending perpendicularly away from to front surface.
Figure 6F:
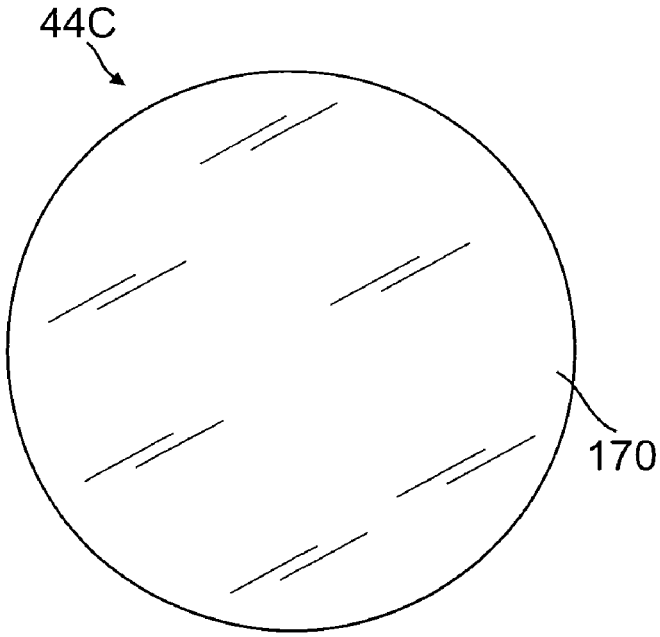
FIG. 6F is a rear plan view of the lens according to the third embodiment of the lens, wherein the rear surface of the lens is smooth or sanded.

The lens 44 of the present invention is round in shape and replaceable. The lens can be transparent, frosted or translucent according to a design of the expected lighting effect. Referring to FIGS. 6A and 6B, there is illustrated first embodiment 44A of the lens, wherein a front surface 160 is frosted and rear surface 162 is smooth, so that the LED is concealed. The first embodiment of the lens causes a light effect to have a spot image as it shines down from the ceiling. As illustrated in FIGS. 6C and 6D, a second embodiment 44B of the lens includes a front surface 164 that is frosted and a rear surface 166 that is sanded and rough, so that the lens generates a light effect to have a widely dispersed image. A third embodiment 44C of the lense is comprised of a front surface 168, which has a plurality of evenly distributed raised prisms or raised dots 169 throughout the surface extending perpendicularly away therefrom, as compared with a rear surface 170 that is smooth or sanded. Therefore, the lense 44C generates a light effect to have a more widely dispersed image, as compared with the second embodiment 44B of the lens.

The hollow light reflector 48 is comprised of a bottom rim 50 and a top dome 52, which can be made of various materials and have various types of interior texture based on a design of the expected lighting effect. For example, the reflector can be made of polished aluminum having a smooth interior surface, which is incorporated with a transparent lens for achieving an intensive lighting effect.

As previously discussed, the heat dissipation means of the present invention is a detachable structure including a lower or first heat dissipation member or section 58 and an upper or second heat dissipation member or section 84 which are mated together as previously discussed. This makes replacement of the LED chip possible since it is removably attached on the bottom side of the upper member 84. The lower section 58 includes a bottom transverse ring 60 having a top surface 62 and bottom surface 66. A plurality of affixing means 64 are circumferentially spaced onto the top surface 62, such as supports having the respective openings. The openings of the respective affixing means further penetrate through the transverse ring for affixing the lower member 58 to the bottom hollow cylindrical ring cover 20.

When assembling the present invention lighting luminaire 10, the lens 44 is positioned on the interior circumferential shelf of the bottom hollow cylindrical trim ring cover 20. The hollow reflector 46 is then positioned, wherein the rim 50 of the reflector presses against the lens 44 so that the trim ring cover 20 and reflector 46 are concentrically aligned together. The lower heat dissipation section 58 is affixed to the trim ring cover, where the bottom exterior surface 66 of the transverse ring 60 connects to the top 32 of the cylindrical wall 28 of the trim ring cover. In addition, a plurality of screws penetrate through the respective affixing means 64 positioned on the bottom ring 60 of the lower section to connect to the respective threaded holes on the top of the cylindrical wall 24 of the trim ring cover 20.

The upper heat dissipation section 84, which is attached to the LED chip 76, is then connected to the lower heat dissipation section 58, wherein the mating ring surface 89 connects to the top 70 of the lower heat dissipation section 58. The affixation is completed with application of a plurality of screws 104, which penetrate the respective connecting openings 87 of the upper heat dissipation section 84 to connect to the respective threaded openings of the lower heat dissipation section 58.

The top dome 52 of the reflector 46 is captured by the mating ring surface 89 of the upper section 84 so that illumination emitted by the LED chip is surrounded by the reflector to generate an enhanced lighting effect. In addition, the longitudinal veins or fins 72 are aligned with the respective longer and shorter longitudinal veins or fins 90 and 92 of the upper heat dissipation member 84, which is illustrated in FIG. 5.

The socket supporting member 106 is then affixed to the upper heat dissipation member 84, wherein the transverse plate 110 is connected to the top sides 99 of the respective two longitudinal supports 98. After the driver is placed on the transverse plate 110, two fastening means 132 are applied, wherein their respective threaded bottom ends 134 penetrate through the respective connecting hooks 126 of the driver 116 and two openings 112 of the socket supporting member 106 to connect to the threaded openings of the respective two longitudinal supports 98. The connecting hooks 126 are pressed to come into contact with the transverse plate 110 by the respective shoulders 136 of the fastening means 132. The last step in assembling of the light luminaire 10 is to affix the top round plate 138 to the respective fastening means 132 through connection of two screws 146 which connect to the respective threaded top openings of the fastening means 132 after the longitudinal socket receiving plate 108 penetrates through the slot 142 of the top plate.

The present invention lighting luminaire 10 has many unique structural features that provide user-friendly properties and are more convenient in the luminaire maintenance. As illustrated before, the lighting luminaire 10 has the central transverse or horizontal fins 100, as compared with the existing lighting luminaires in the market that lacks such fins to cause the driver to be directly contacted by a top of a heat dissipation structure. Therefore, the present invention lighting luminaire having the transverse fins provides more cooling power for heat dissipation.

Referring to FIG. 2, there are illustrated air gaps 148 and 150. The gap 148 is positioned between a bottom side of the transverse plate 110 and the top sides 102 and 93 of the respective central transverse fins 100 and shorter longitudinal fins 92. The gap 150 is positioned between the top round plate 138 and a top side of the driver 116. It will be appreciated that these two air gaps, which are specifically designed in the present invention, provide additional pathways for air circulation to thereby dissipate the heat, as compared with the existing lighting luminaires in the current market that do not have these air gaps. Therefore, this combination of air gaps and central transverse fins 100, provides a significant improvement for dissipation of the heat generated by the LED chip in use.

Referring to the above illustration of the structural components and procedures to assemble the lighting fixture, it is evident that the present invention lighting luminaire possesses the features of the detachable components which are replaceable, such as the detachable heat dissipation means having the upper and lower sections 58 and 84, and the detachable LED chip. Such characteristics provides more convenience in service especially in repairing the luminaire. This provides a significant benefit over the existing lighting luminaires in the market which have heat dissipation apparatus that are the non-detachable single units and LED chips that are non-replaceable. The present invention also brings a low cost in maintenance of the lighting luminaire since each component is replaceable if it malfunctions.

It will be additionally appreciated that the present invention design includes the detachable electrical connector. Therefore for connecting the lighting luminaire to the ceiling electricity supply, a user can first complete the connection of the male connector 124 to a female socket positioned inside of a canister which is positioned on the ceiling, and then connect the first member 120 to the second member 122 of the detachable electrical connector for completion of the wire connection. The result is that serious twisting of the inlet electricity wires 118, which occurs in the installation of the existing lighting fixture, can be avoided to thereby prevent damage of the electrical wires.

It will be further appreciated that the present invention provides the socket supporting member 106 having the top socket affixing means, which can affix a removable female socket that is transversely oriented. Therefore, the transverse orientation in installation of the female socket makes the present invention more versatile. This is because it decreases overall height of the lighting luminaire in installation as compared with the socket being longitudinally oriented. Therefore, the present invention will fit even in shorter applications. Such advantage of versatility is compared with the existing lighting luminaires, wherein its longitudinal height in installation may be too long to fit all conditions of the ceiling structure.

It will be additionally appreciated that the present invention provides the transverse circumferential baffles on the interior surface of the bottom ring cover, which are able to produce aesthetic lighting effect when the lighting luminaire is in use. This is advantageous, as compared with a smooth interior surface or the longitudinal steps on the interior surface of the existing lighting luminaires in the market which produce the lighting effect that is less attractive.

In addition, the present invention lighting luminaire uses a single LED chip, as compared with multiple chips employed in the existing lighting luminaire, which provides simplicity in use and maintenance of the lighting fixture.

Of course the present invention is not intended to be restricted to any particular form or arrangement, or any specific embodiment, or any specific use, disclosed herein, since the same may be modified in various particulars or relations without departing from the spirit or scope of the claimed invention hereinabove shown and described of which the apparatus or method shown is intended only for illustration and disclosure of an operative embodiment and not to show all of the various forms or modifications in which this invention might be embodied or operated.

What is claimed is:

1. A luminaire to be used in conjunction with a housing retaining a female threaded socket electrically connected to a source of power, comprising:

a. a bottom hollow trim ring cover including a trim ring and a hollow cylindrical wall having a top service and an interior circumferential shelf adjacent the top surface, and means to retain the trim ring cover within a housing in a ceiling fixture;

b. a removable and replaceable lens resting on the interior shelf of the hollow cylindrical wall of the trim ring cover and a removable and replaceable dome shaped reflector having a dome shaped wall with an interior surface and a lower rim which rests on said lens and an opening a top of the dome shaped wall;

c. a removable and replaceable a heat dissipation apparatus including detachable lower and upper sections, (i) said lower section having a circumferential connecting ring incorporated into a frustum shaped hollow body having an interior surface, an exterior surface and a circumferential top end surrounding a central opening, said frustum shaped hollow body extending into a lower circumferential surface which lies interiorly of and is attached to an upper surface of the connecting ring, a multiplicity of spaced apart longitudinal fins attached to and extending radially away from said exterior surface of the frustum shaped body and also are attached to the lower circumferential surface, each longitudinal fin being separated from an adjacent longitudinal fin by an air gap, (ii) said upper section including a circumferential plate having a bottom central recessed surface connected to a bottom circumferential mating ring surface, a multiplicity of spaced apart long longitudinal heat dissipation fins respectively separated by air gaps and a multiplicity of spaced apart short heat dissipation fins respectively separated air gaps, the long longitudinal heat dissipation fins and short longitudinal heat dissipation fins extending circumferentially around and connected to the circumferential plate, a multiplicity of spaced apart horizontal heat dissipation fins separated by air gaps attached to a top surface of the circumferential plate, the horizontal fins surrounded by the long longitudinal fins and short longitudinal fins to form a top central recess area above the horizontal fins and within the long longitudinal fins, an LED chip removably affixed to said bottom central recessed surface of said round plate, and electrically connected to a driver, the first and second sections connected together so that a respective longitudinal fin of the first section is respectively aligned with either a long longitudinal fin or a short longitudinal fin of the second section, and the LED chip faces into the interior of the first section and can illuminate through the top opening in the reflector;

c. an "L" shaped socket supporting member including top socket affixing means and a bottom transverse plate which rests above the horizontal fins and is connected to the second section so that an air gap is formed between a bottom surface of the transverse plate and the horizontal fins;

d. a detachable electrical connector including first and second mating connecting members that are matched each other, wherein the second mating connector member is connected by electrical wires to a removable and replaceable male connecting socket and the first mating connecting member is connected by electrical wires to a removable and replaceable driver;

e. the driver resting on the horizontal fins and partially surrounded by the long longitudinal fins of the second section of the heat dissipation member, the multiplicity of longitudinal fins and air gaps enabling heat from the LED chip to be dissipated into a ceiling fixture to enable the driver to run at reduced temperatures; and f. a top cover having a slot to permit the top socket affixing means to extend through it and the top cover attached to the heat dissipating member so that an open air gap is formed between the cover and the driver;

g. whereby after the male threaded socket is threaded into the female threaded socket, the luminaire is retained within the housing.

2. The luminaire in accordance with claim 1 wherein the interior wall of the cylindrical trim ring cover has interior transverse baffles.

3. The luminaire in accordance with claim 1 wherein the replaceable lens has an exterior frosted surface which is smooth and an interior surface which is smooth.

4. The luminaire in accordance with claim 1 wherein the replaceable lens has an exterior frosted surface which is smooth and an interior surface which is sanded.

5. The luminaire in accordance with claim 1 wherein the replaceable lens has an exterior frosted surface which includes a multiplicity of prisms extending away from the from exterior surface and an interior surface which is smooth.

6. The luminaire in accordance with claim 1 wherein the replaceable lens has an exterior frosted surface which includes a multiplicity of prisms extending away from the from exterior surface and an interior surface which is sanded.

7. The luminaire in accordance with claim 1 further comprising an electrical thermally conductive adhesive patch between the LED chip and the bottom central recessed surface to which the LED chip is attached.

8. The luminaire in accordance with claim 1 wherein the LED chip is a single chip which delivers white light.

9. A luminaire to be used in conjunction with a housing retaining a female threaded socket electrically connected to a source of power, comprising:

a. a bottom hollow trim ring cover including means to retain the trim ring cover within a housing in a ceiling fixture;

b. a removable and replaceable lens retained within the trim ring cover and a reflector resting over the lens;

c. a removable and replaceable a heat dissipation apparatus including detachable lower and upper sections, (i) said lower section having a hollow body having an interior surface, an exterior surface and a circumferential top end surrounding a central opening, a multiplicity of spaced apart longitudinal fins attached to and extending radially away from said exterior surface of the body, each longitudinal fin being separated from an adjacent longitudinal fin by an air gap, (ii) said upper section including a circumferential plate having a bottom central recessed surface, a multiplicity of spaced apart long longitudinal heat dissipation fins respectively separated by air gaps and a multiplicity of spaced apart short heat dissipation fins respectively separated air gaps, the long longitudinal heat dissipation fins and short longitudinal heat dissipation fins extending circumferentially around and connected to the circumferential plate, a multiplicity of spaced apart horizontal heat dissipation fins separated by air gaps attached to a top surface of the circumferential plate, the horizontal fins surrounded by the long longitudinal fins and short longitudinal fins to form a top central recess area above the horizontal fins and within the long longitudinal fins, an LED chip removably affixed to said bottom central recessed surface of said round plate and electrically connected to a driver, the first and second sections connected together so that a respective longitudinal fin of the first section is respectively aligned with either a long longitudinal fin or a short longitudinal fin of the second section, and the LED chip faces into the interior of the first section and can illuminate through the reflector;

d. a socket supporting member including top socket affixing means and a bottom transverse plate which rests above the horizontal fins and is connected to the second section so that an air gap is formed between a bottom surface of the transverse plate and the horizontal fins;

e. a detachable electrical connector including first and second mating connecting members that are matched each other, wherein the second mating connector member is connected by electrical wires to a removable and replaceable male connecting socket and the first mating connecting member is connected by electrical wires to a removable and replaceable driver;

f. the driver resting on the horizontal fins and partially surrounded by the long longitudinal fins of the second section of the heat dissipation member, the multiplicity of longitudinal fins and air gaps enabling heat from the LED chip to be dissipated into a ceiling fixture to enable the driver to run at reduced temperatures; and g. a top cover having a slot to permit the top socket affixing means to extend through it and the top cover attached to the heat dissipating member so that an open air gap is formed between the cover and the driver;

h. whereby after the male threaded socket is threaded into the female threaded socket, the luminaire is retained within the housing.

10. The luminaire in accordance with claim 9 wherein the interior wall of the cylindrical trim ring cover has interior transverse baffles.

11. The luminaire in accordance with claim 9 wherein the replaceable lens has an exterior frosted surface which is smooth and an interior surface which is smooth.

12. The luminaire in accordance with claim 9 wherein the replaceable lens has an exterior frosted surface which is smooth and an interior surface which is sanded.

13. The luminaire in accordance with claim 9 wherein the replaceable lens has an exterior frosted surface which includes a multiplicity of prisms extending away from the from exterior surface and an interior surface which is smooth.

14. The luminaire in accordance with claim 9 wherein the replaceable lens has an exterior frosted surface which includes a multiplicity of prisms extending away from the from exterior surface and an interior surface which is sanded.

15. The luminaire in accordance with claim 9 further comprising an electrical thermally conductive adhesive patch between the LED chip and the bottom central recessed surface to which the LED chip is attached.

16. The luminaire in accordance with claim 9 wherein the LED chip is a single chip which delivers white light.

* * * * *